US005392931A

United States Patent [19]

Bielagus

[11] Patent Number: 5,392,931

[45] Date of Patent: Feb. 28, 1995

[54] ADJUSTABLE BAR SCREEN

[75] Inventor: Joseph B. Bielagus, Tualatin, Oreg. B. Bielagus, Tualatin.

[73] Assignee: Beloit Technologies, Inc., Wilmington, Del.

[21] Appl. No.: 250,256

[22] Filed: May 25, 1994

Related U.S. Application Data

[62] Division of Ser. No. 129,845, Sep. 30, 1993.

[51] Int. Cl.[6] ..... B07B 1/46

[52] U.S. Cl. ..... 209/674; 209/394

[58] Field of Search ..... 209/674, 679, 676, 393–396

[56] References Cited

U.S. PATENT DOCUMENTS

| | | | |
|---|---|---|---|
| 1,961,534 | 6/1934 | Symons | 209/396 |
| 3,123,558 | 3/1964 | Sullivan | 209/393 X |
| 3,204,605 | 9/1965 | Vroman | 209/394 X |
| 5,117,983 | 6/1992 | Marrs | 209/674 |

*Primary Examiner*—D. Glenn Dayoan

*Attorney, Agent, or Firm*—Dirk J. Veneman; Raymond W. Campbell

[57] ABSTRACT

The bars of one of two sets of interleaved screen bars is extended beyond the interleaved portion of the screen bed, thus forming a region of the screen bed which has screens particles of intermediate dimensions. A second improvement is a clamping member which holds the downwardly extending legs of individual bars of the screen. The clamping member is a steel channel which has a steeply peaked roof between legs which sheds particles. The bar legs fit into slots which penetrate the peaked roof transverse to the lengthwise direction of the channel. The legs are retained by transverse bolts which pass through the vertical sidewalls of the channel and the legs, retaining and clamping them. The third improvement mounts the clamping member to a flange which may be traversed by a screw and bolt arrangement such that the clamping member may be adjusted in its lateral position. A fourth improvement is a clamping member which extends longitudinally and which has a keyway formed therein. Bars with downwardly extending legs extend transversely to the direction of the clamping member. The legs have transverse keys which fit into the keyway formed in the clamping member.

3 Claims, 7 Drawing Sheets

ADJUSTABLE BAR SCREEN

This is a divisional of co-pending application Ser. No. 08/129,845, filed on Sep. 30, 1993.

FIELD OF THE INVENTION

The present invention relates to apparatus for screening particulate material such as wood chips in general, and in particular to bar green apparatus having a screening deck defining a screening area, wherein the deck is formed of a series of parallel bars with spaces therebetween.

BACKGROUND OF THE INVENTION

In a common process for the manufacture of pulp for producing paper, logs are reduced to chips by chipping mechanisms, and the chips are cooked with chemicals at elevated pressures and temperature to remove lignin. The chipping mechanisms produce chips which vary considerably in size and shape. For the cooking process, which is known as digesting, it is desirable that the chips supplied have a uniform thickness in order to achieve optimum yield and quality; that is, to obtain a pulp which contains a low percentage of undigested and/or over-treated fibers. Under preferred conditions of digesting, the pulping chemicals or liquor penetrate into chips uniformly. If chips are provided which have too great a thickness, the liquor may not adequately penetrate the chips and the digester will produce chips with a core of under-digested fibers. If chips are provided which are too thin, the digester will produce chips that are overcooked and of low quality. To insure proper delignification of the chips in the production of pulp, the supply should not contain chips having an excessive thickness which will give rise to lack of adequate penetration during the digestion process, nor chips which are overly thin and may be over-treated during the digestion process.

Two types of apparatus has been provided heretofore for screening chips to separate the over-thick and under-thick chips from those within the desired thickness range. One type of screening device is a disk screen. A disk screen has a plurality of generally circular disks mounted on parallel, rotating shafts. The disks are mounted coaxially on each shaft and spaced from each other, and the disks interleave with the disks of adjacent shafts to form screening gaps between the disks of one shaft and the disks of adjacent shafts. Through proper disk spacing, the screen can be used to separate either under-size or over-size chips from a stream of chips supplied to the screen.

A second type of screening apparatus for wood chips or the like which has substantially higher industrial capacity than a disk screen is a bar screen. A bar screen has a screening deck or bed which extends substantially horizontally, thus providing a large screening area. Chips are distributed across a receiving end of the screening deck, which is formed by a series of parallel bars having a particular top shape. Relative oscillatory motion is effected between sets of bars for effecting screening and moving the chips in a forward direction.

Bar screens have also been found to be useful for separating refuse and trash as an important step in recycling such materials.

Known bar screens separate a flow of material into two streams, an accept stream and a reject stream. In many circumstances, the reject stream will be further processed. Further processing of the reject stream would be greatly aided by an ability to divide the rejected stream into oversized and grossly oversized materials.

In processing municipal waste and the like, the spacing of the screen bars may need to be adjusted from one lot of material to another. On conventional bar screens, bar spacing can require the change-out of a bar positioning and retention member.

Yet another problem associated with known bar screens is the difficulty of aligning the interleaved sets of bars so that the space between bars is even and does not vary between the front and back of the bar screen.

What is needed is an improved mechanism for clamping bar screens to bar retention members which allows their ready replacement and adjustment. Further, a bar screen which separates the rejected material into oversized and grossly oversized is needed. Still further, an adjustment mechanism is needed which allows one person to adjust the spacing between the interleaved bars of the two bar racks of a bar screen.

SUMMARY OF THE INVENTION

The bar screen apparatus of this invention employs one or more of four distinct improvements in the construction of a bar screen. The first improvement consists of extending the bars of one of two sets of interleaved screen bars beyond the interleaved portion of the screen bed, thus forming a region of the screen bed which has larger openings. Thus, a stream of wood chips or the like passing over the bar screen bed will be separated into three streams, one which will pass through the interleaved sets of oscillating interleaved bars, and an oversized stream which will pass through a single set of bars of one of the screens that extends beyond the interleaved portion of the bed. Finally, a grossly over-large stream of material will exit the end of the bar screen bed.

The second improvement involves the construction of a clamping member for holding legs which extend downwardly of individual screen bars. The clamping member holds a group of bars in parallel spaced relation, so forming a grid of screening bars. Two such grids of screening bars are interleaved to form the screen bed. The improved clamping member is a steel channel which has two vertical side walls with a steeply peaked roof. Flanges on either side of the channel are bolted to a beam which imparts an oscillator motion to the clamping member and retained screen bars. The clamping member is transverse to the length-wise direction of the bars. The bar legs extend downwardly through slob in the peaked roof. The bar legs are retained in the clamping member by transverse retaining bolts which pass through the channel sidewalls and the legs, thus retaining and clamping the bars.

A third improvement is to mount a downwardly extending bracket to the clamping member which engages with a threaded rod connected to the oscillating member. The clamping member may thus be traversed by a screw and bolt arrangement laterally along oscillating member to adjust the spacing between the bars of the displaced rack and another interleaved rack. The clamping member is fixed to the oscillating beam by bolts which extend through over-sized slob in flanges which extend from the clamping member. The clamping member may be thus rapidly positioned without the need to actually remove the fasteners during positioning.

A fourth improvement which may be applied to a bar screen, particularly one used to separate municipal waste, is to form the clamping member as a single vertical plate with a horizontal slot therein which defines a keyway. The bar legs are formed with projecting keys which mate with the keyway formed in the clamping member plate. Two bolts pass through the projecting key on each bar leg and join a backing bar having two threaded holes to the keyed bar leg. Thus, the individual bars forming the screen may be conveniently laterally adjusted to readily adapt the bar screen to a particular type of material to be sorted.

It is an object of the present invention to provide a bar screen which separates material into three streams.

It is also an object of the present invention to provide a bar screen which may be readily aligned by a single person.

It is another object of the present invention to provide a bar screen in which the spacing between bars may be readily adjusted.

It is a further object of the present invention to provide a bar screen which prevents the build-up of material on the clamping member.

It is yet another object of the present invention to provide a bar screen having a clamping member which releasably engages and holds the bars forming the screen.

Further objects, features, and advantages of the invention will be apparent from the following detailed description when taken in conjunction with the accompanying drawings.

DESCRIPTION OF THE PREFERRED EMBODIMENTS

Figure 1:
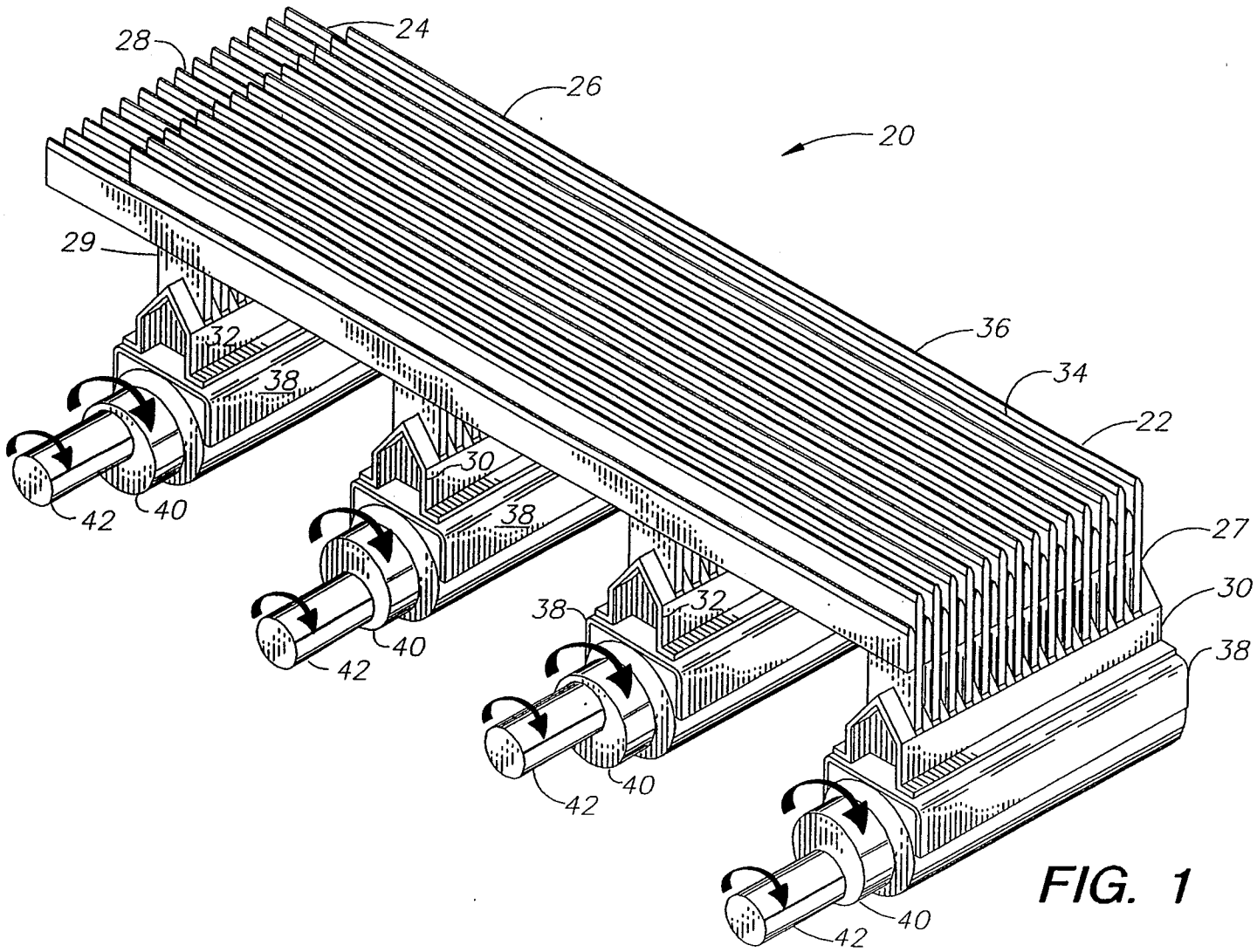
FIG. 1 is a somewhat schematic, isometric view of the improved bar screen of this invention.

Referring more particularly to FIGS. 1–7, wherein like numbers refer to similar parts, a bar screen 20 is shown in FIG. 1. The bar screen 20 consists of a first rack 22 and a second rack 24. The first rack is made up out of a multiplicity of first screening bars 26. The second rack 24 is constructed of a multiplicity of second screening bars 28.

The first bars 26 of the first rack 22 have legs 27 which are held in spaced relation by two first clamping members 30. The bars 28 of the second rack 24 have legs 29 and are held in spaced parallel relation by two second clamping members 32. Each clamping member is connected to an oscillating beam 38. The first bars 26 and the second bars 28 are interleaved or interdigitated, and are so spaced that there are gaps 34 between the first bars 26 and the second bars 28. The gaps 34 form the openings for wood chips (not shown), municipal waste (not shown), or the like, of a predetermined size to pass through the screen bed 36. The screen bars 26, 28 are mounted by the depending legs 27, 29 to the clamping members 30,32.

The oscillating beams are rotatively mounted on shafts 40 which are eccentrically driven by eccentric shafts 42. The motion of the eccentric shafts 42 causes the oscillating beams 38 to move up and down, as well in the direction of chip flow. The beams 38 to which the first bars 26 of the first rack 22 are mounted are 180 degrees out of phase with the beams 38 to which the bars 28 of the second rack 24 are mounted.

The bar screen differs from an ordinary screen in that it can separate a granular material such as wood chips based on a single dimension, chip thickness. This is critical in the pulping of wood chips, as it is the smallest dimension, the thickness of the chips, which governs the rate of digestion of the chip by a pulping liquor which dissolves the lignin in order to release the wood fibers in the chips. This ability to separate based on a single dimension of a material has also been found to have great utility in separating municipal waste into different streams of material which are recycled by different processes.

The bar screen 20 separates material into two categories, that which passes through the bar screen, and that which progresses over the screen bed 36. If separation into more categories is needed, two or more bar screens can be used. However, in many circumstances, where the cost of another bar screen is not justified, it is still desirable to separate the rejected stream into materials which are grossly over-sized versus those which, while too big to pass the screen bed 36, are only slightly too large.

An example of this is in the paper making industry, wherein chips passing the screen bed 36 would be sent directly to a wood chip digester, and wherein grossly over-sized materials would be discarded. Middling chips, which are not grossly over-sized, can be further processed in a slicer or chip destructuring device which cracks the chips by passing them through the nip of two opposed rollers.

Figure 2:
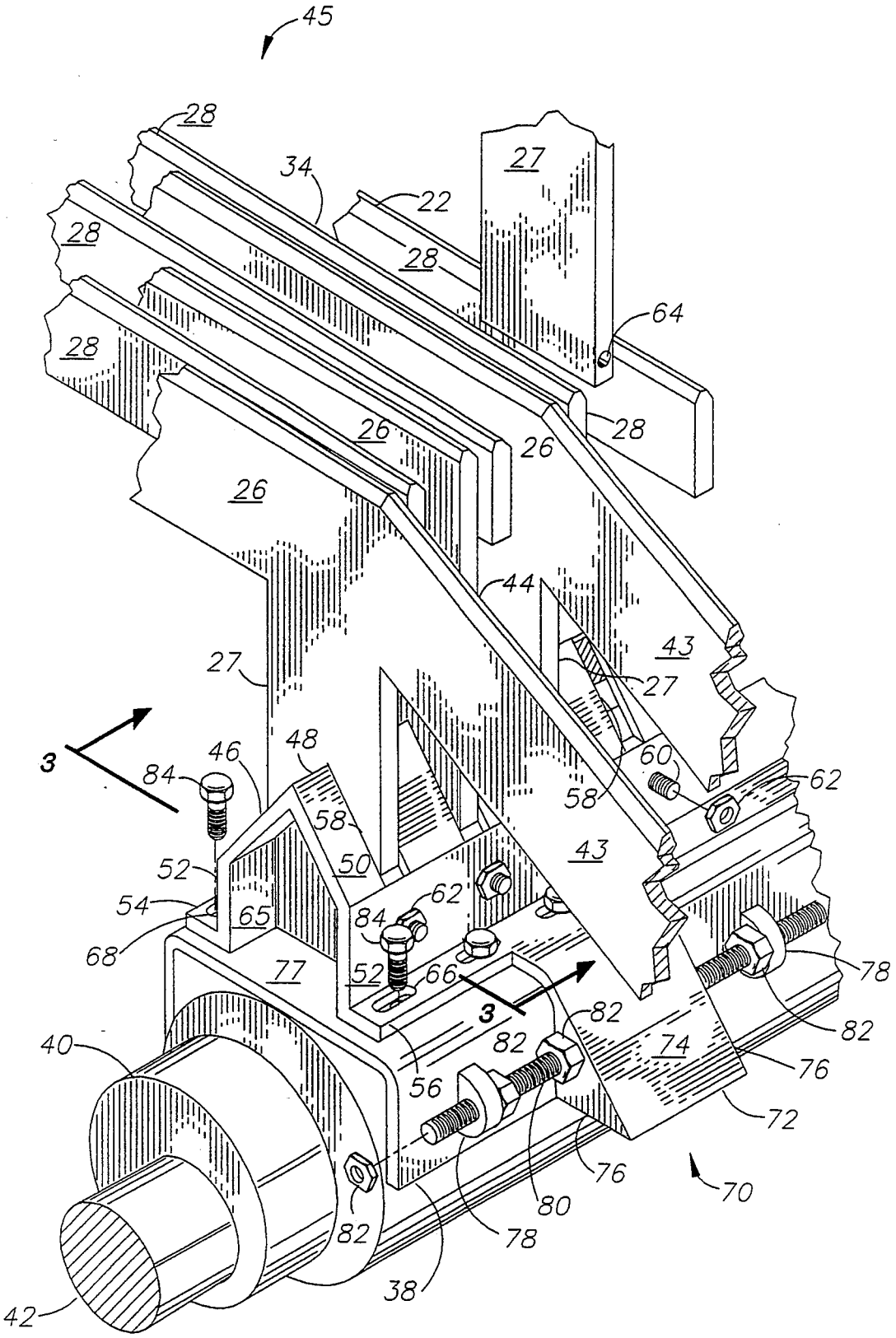
FIG. 2 is a fragmentary, partly exploded isometric view of an alternative embodiment bar green of this invention.

Referring to FIG. 2, a bar screen 45 is shown in which the first set of screen bars 26 have been extended with sloped extensions 43 which cream a short extension screen bed 44 with wider spacing between first bars 26, because they are not interleaved in the extension screen bed with the bars 28 of the second rack 24. The extensions 43 extend beyond the bars of the second rack at an angle of between ten degrees and thirty degrees with respect to the plane of the bars of the second rack.

Although the extension bed 44 is shown formed by the bars 26 of a single rack 22, the extension bed 44 could be formed by extending every other bar of both racks 22, 24, or every third bar, etc.

Alternatively, all the bars could be extended for a short distance with the extended portions formed to have a narrower width, such that the gaps 34 are increased in width.

Figure 3:
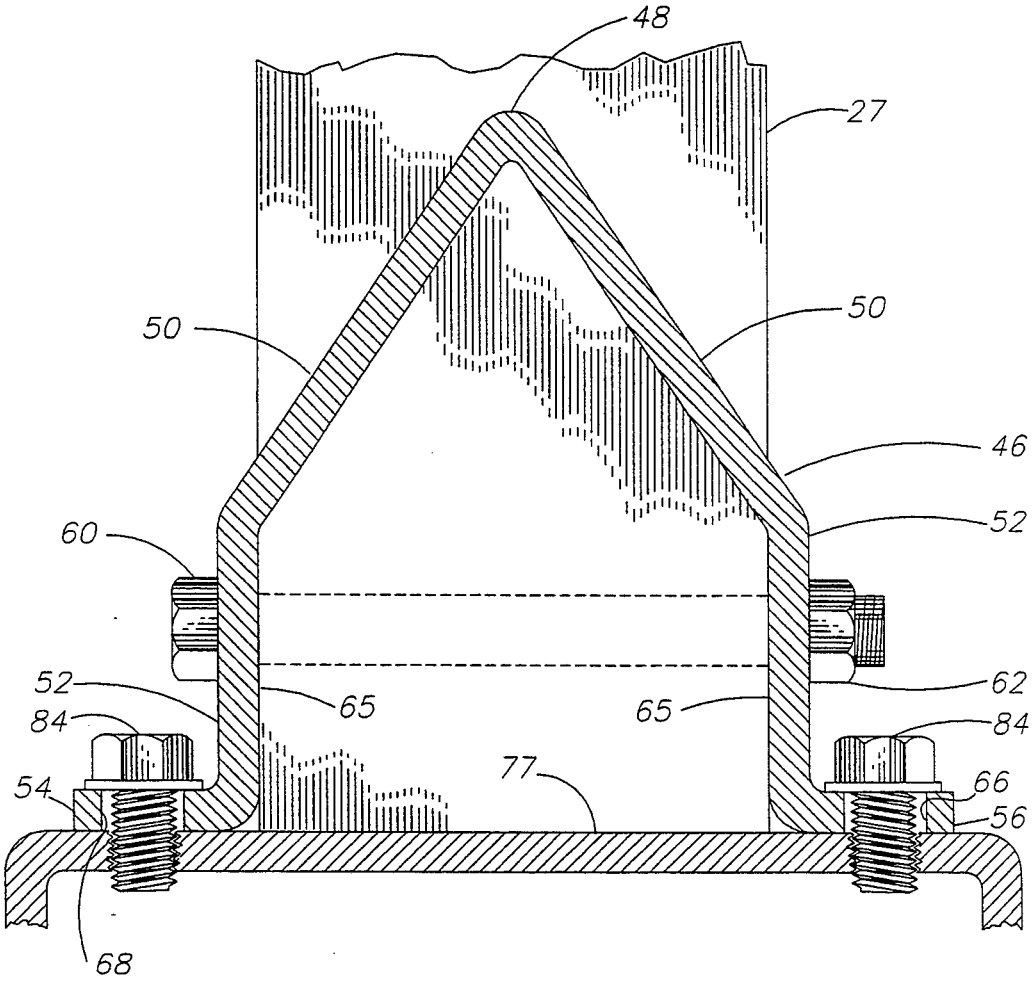
FIG. 3 is a cross-sectional view of the clamping member of the apparatus of FIG. 2 taken along section line 3—3.

As best shown in FIGS. 2 and 3, the clamping member 30 has a channel 46 having a cross-section shaped like a peaked roof house. The channel 46 has two vertical sidewalls 52, and a peak 48 formed at the meeting of two sloping roof sides 50 which extend upwardly from the sidewalls. The sidewalls 52 of the channel 46 are joined to an inside flange 54 and outside flange 56. Slots 58 are formed in the channel 46 which extend transversely across the roof sides 50 and the roof peak 48 between the side walls 52.

The screen bar support legs 27 extend downwardly into the slots 58 between the sidewalls 52 of the clamping member channel 46. The legs 27 are connected to the channel 46 by bolts 60 with end nuts 62 which pass through holes 64 in the legs 27.

The peaked-house cross-section channel 46 imparts two advantages over known clamping members which have shed-like cross-sections with a single pitch, more gently sloped roof. The first advantage is that the steeply sloped roof sides 50 and the peak 48 tend to readily shed wood chips or other screened materials, preventing a build-up of such materials on the clamping member 30. The other advantage is that the peaked roof cross-section 46, and particularly the roof peak 48, renders the sides 52 sufficiently hingedly connected so that they may be drawn together by the bolts 60 and nuts 62, thus clamping the screen bar legs 27 between the sides 52 of the clamping member 30. This clamping action prevents wear between the leg 27 and the bolt 60.

Figure 6:
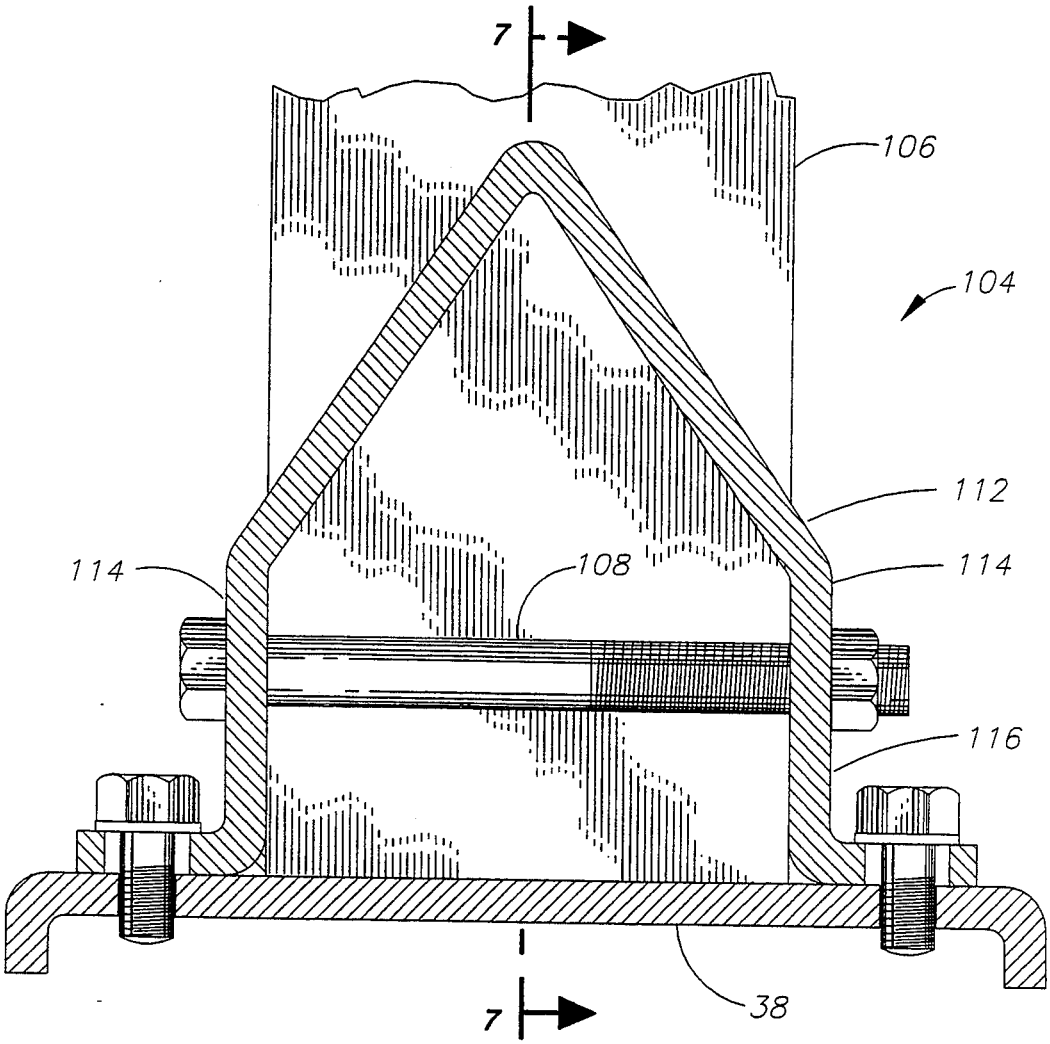
FIG. 6 is a cross-sectional view of an alternative embodiment screen having screen bar legs which are clamped between the walls of the clamping member channel.
Figure 7:
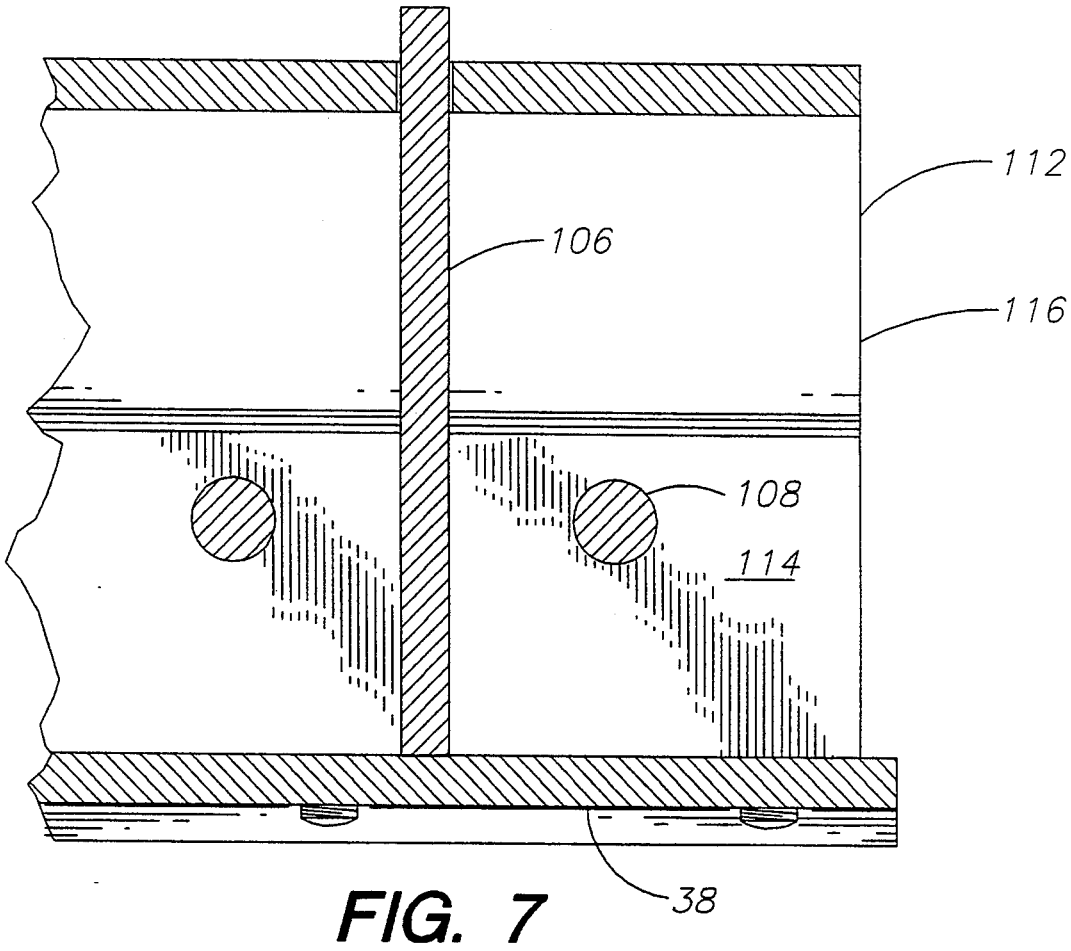
FIG. 7 is a cross-sectional view of the apparatus of FIG. 6 taken along section line 7—7.

An alternative bar screen 104 is shown in FIGS. 6 and 7. The bar screen 104 has legs 106 which are not sufficiently thick for a bolt hole to be formed therein. Bolts 108 extend through bolt holes 110 in the channel 112 side walls 114 and positions intermediate between slots in the channel. The bolts 108 thus extend between adjacent legs 106 and clamp the two side walls 114 toward one another, clamping the leg 106 therebetween. The clamping action alone is relied on to hold the legs 108 (and thus their supported bars) in place on the clamping member 116.

The peaked channel 46 also facilitates the resilient mounting of the bar legs 27 inasmuch as the insides 66 of the sidewalls 52 could be lined with a resilient material such as rubber for gripping the legs 27 with damping effect.

As shown in FIG. 3, because the sides 52 may be moved inwardly relative to each other, the bolt holes 66 on the flange 56 are over-sized, to allow for this motion. The bolt holes 66 in the outside flange 56 and the bolt hole 68 in the inside flange 54 are also oblong, as shown in FIG. 2. The oblong bolt holes 66, 68 facilitate the positioning of the clamping member 30 by a lateral adjustment mechanism 70.

The lateral adjustment mechanism 70 has a positioning bracket 72 which is rigidly attached to the clamping member 30 at the outside flange 56. The positioning bracket 72 is formed of a downwardly sloping side plate 74 which is connected to two vertical end plates 76. The positioning bracket 72 and connected clamping member 30 rides on the top surface 77 of the oscillating beam 38. The top surface 77 is generally planar, and may be formed as a portion of an inverted U-channel welded integrally to the oscillating beam 38. Due to the oblong shape of the bolt holes 66, 68 in the clamping member channel 46, the clamping member may be repositioned with respect to the oscillating beam 38 by simply loosening the bolts 84 to allow play, but without the need to remove the bolts 84.

Two ears 78 extend outwardly from the oscillating beam 38 on either side of the positioning bracket 72. A threaded rod 80 extends through the ears 78 and the side plates 74 of the positioning bracket. Nuts 82 are threadedly mounted on the threaded rod 80 and positioned on either side of the ears 76 and the positioning bracket 72. The nuts 82 may be positioned to adjust the position of the sliding bracket 72 and the connected clamping member 30 with respect to the oscillating beam 38. The adjustment mechanism 70 allows one person with a wrench to position the clamping member 30 with respect to the oscillating beam 28. By employing a lateral adjustment mechanism 70 on each oscillating beam of a bar screen assembly, the bars of the first rack may be aligned with the bars of the second rack. The adjustment mechanism 70 may also be used to make sure that the bar gaps 34 on either side of the bars 26 are uniform, so that the bar screen will separate wood chips and the like of a uniform size.

Once the clamping member 30 has been positioned by the lateral adjustment mechanism 70, the clamping member bolts 84 may then be tightened to clamp the flanges 54, 56 of the clamping member 30 to the oscillating beam 38. In some circumstances, it may be desirable to replace the clamping bolts 84 in the inside flange 54 with simple pins.

In using a bar screen to separate wood chips, the desired screen spacing will only be infrequently changed, and this change can be accommodated by replacing the clamping member 30 with a clamping member with more narrowly or widely spaced slots 58. However, in some applications, particularly in separating municipal waste, adjustments in the spacing between the bars of a bar screen may be required more frequently, either because the waste stream is changing in content, or because of the necessity of varying the bar spacing to find the optimal spacing for separating various components of municipal waste.

Figure 4:
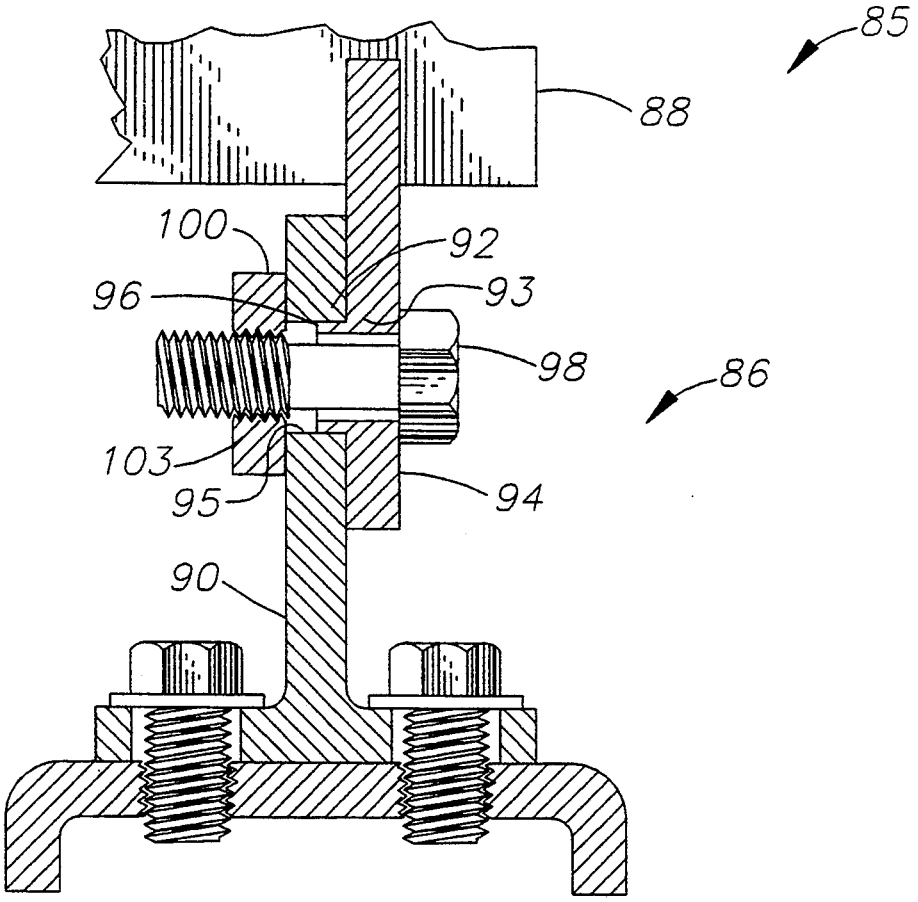
FIG. 4 is a cross-sectional view of another alternative embodiment clamping member and bar leg arrangement of FIG. 5 taken along section line 4—4.
Figure 5:
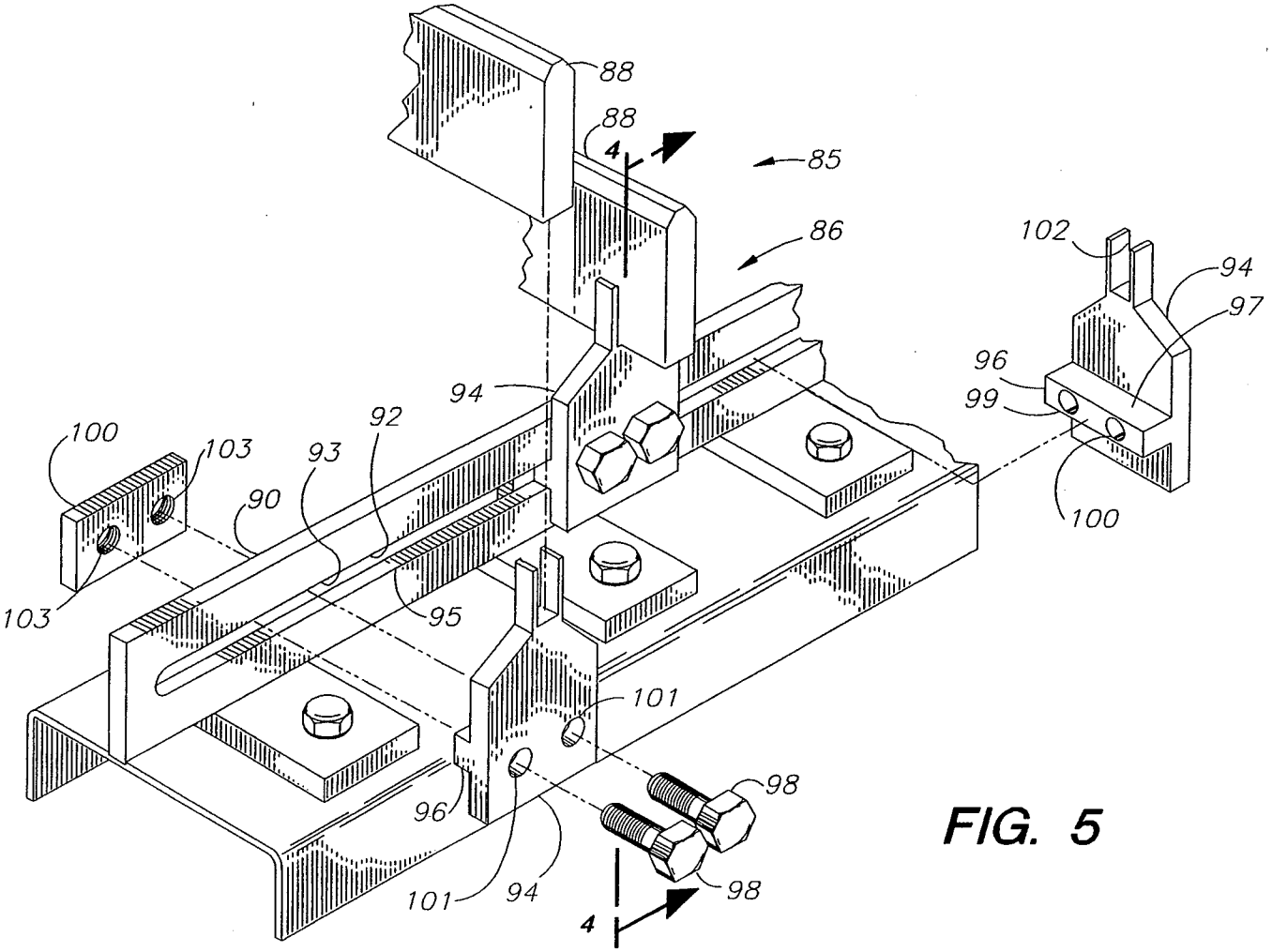
FIG. 5 is a fragmentary, partly exploded isometric view of the apparatus of FIG. 4.

An alternative bar screen 85 with adjustable spacing between the bars within each rack is shown in FIGS. 4 and 5. The bar screen 85 has an adjustable bar leg clamping assembly 86 which facilitates spacing screening bars 88 in a readily adjustable manner. The screening bars 88 are connected such as by welding to upright adjustable legs 94. The clamping member is formed as single upright plate 90 with portions defining a transverse keyway 92. The keyway 92 is a horizontally extending slot with an upper slot surface 93 which faces a parallel lower slot surface 95. Each leg 94 extends perpendicularly to the attached bar 88 and is thus significantly wider than the bar. A projection or key 96 is formed on each leg 94 which extends into the keyway slot 92 and which has an upper surface 97 and a lower surface 99 which are spaced apart approximately the same distance as the slot upper surface 93 is paced from the slot lower surface 95. The key 96 thus mates within the slot 92, with appropriate clearance to permit free movement of the leg 94 within the slot, but such that possible tilting of the attached bars 88 is strictly limited by the engagement of the key upper and lower surfaces with the slot upper and lower surfaces. Two bolt holes 101 extend through the leg 94 midway through the projecting key 96. Two bolts 98 pass through the leg bolt holes 191 and engage with threaded holes 103 in a rectangular backing plate 100. The legs 94 may be positioned along the plate 90 by loosening the bolts 98 and sliding the leg, bolt, backing plate assembly along the keyway 92. When the leg 96 and its supported bar 88 are properly positioned, the bolts 98 may be tightened, clamping the bar 88 into position. The key 96 interfits with the keyway 92 and prevents lateral tipping of the bars 88 in response to side loads caused by wood chips or the like passing through the bars 88. The bars 88 are joined by welding into the upwardly extending slots 102 of the legs 94.

It should be understood that the leg clamping bar arrangement 86 allows the ready adjustment of the inter-bar spacing, as well as the addition of extra bars or the removal of bars, to accommodate a desired change in inter-bar spacing.

For typical wood chip screening, bar displacements of 2 inches to 3 inches are preferred, with the rotary drives to which the bars are eccentrically connected being driven at 200 to 250 r.p.m. Too slow operation and too shallow displacements result in chip matting due to insufficient agitation and insufficient chip tipping. Excessive speeds of the drive cause the chips, and particularly smaller acceptable chips, to become suspended above the screen, limiting engagement time for proper sizing.

It should be noted that one or more of the improved features described above may be utilized in a particular bar screen. For example, the peaked roofed clamping member channel may be employed as in the bar screen 20 FIG. 1 without employing the lateral adjusting mechanism 70.

It should be understood that at least one grid or set of bars may be provided with separate groups of bars having top surfaces disposed in at least two different planes. In such an arrangement, each grid of bars is provided with groups of bars having top surfaces in at least two different planes. That is, the top surfaces of the bars in any given grid do not form a single planar surface. The bars are so arranged that within a given grid or set of bars, adjacent bars are at a different height, and in the assembled bed adjacent bars are from different grids.

It should be understood that the invention is not confined to the particular construction and arrangement of parts herein illustrated and described, but embraces such modified forms thereof as some within the scope of the following claims.

We claim:

1. A bar screening apparatus for separating a particulate material such as municipal waste or wood chips; the apparatus comprising:

a screen rack defining a screening area with screening openings and extending from a receiving end to a discharge end, with delivery means for distributing material onto the screening rack at the receiving end to move toward the discharge end so that large material moves longitudinally the length of the deck from the receiving end to the discharge end, and smaller material passes through the screening deck;

the rack having a plurality of individual screening bars extending from the receiving end to the discharge end and arranged in spaced relationship to define openings therebetween for passing therebetween the smaller material the rack being driven to oscillate in at least a vertical plane, wherein each bar in the racks has downwardly extending legs which join the bars of the racks to a clamping plate which rides on an oscillating member;

portions of the clamping plate which define a keyway extending transverse to the screening bars; and portions of the bar legs which form a protruding key which engages the keyway, the engagement of the protruding key and recessed keyway serving to position the bars and hold the bars against tilting.

2. In a screen apparatus for separating a particulate material such as wood chips based on material thickness, wherein the apparatus includes a plurality of parallel bars defining therebetween screen openings, and the bars are mounted for substantial vertical and horizontal movement, with adjacent bars being collectively mounted in first and second racks and moving in opposite directions, the improvement comprising:

a clamping plate having portions defining a keyway extending transverse to the screening bars, wherein the bars have legs, and each leg has a transverse protruding key thereon which engages the plate keyway, the engaged key and keyway portioning the bar and holding it against tilting.

3. A bar screen for screening wood chips or waste; the apparatus comprising:

a first set of parallel bars which define a first rack;

a second set of parallel bars which define a second rack, wherein the bars of the first rack interleave with the bars of the second rack, and wherein the interleaved bars form screening gaps therebetween;

a leg which extends downwardly from each bar;

a clamping plate which is engaged with the legs of the bars of the first rack, wherein the clamping plate rides on a oscillating member, and is the first rack being thereby driven to oscillate in at least a vertical plane:

portions of the clamping plate which define a slot which extends transverse to the screening bars, the slot having substantially parallel upper and lower slot surfaces; and a protruding key formed on each bar leg which extends into the slot in the clamping plate, the key having substantially parallel upper and lower surfaces which engage the upper and lowers slot surfaces, respectively, of the keyway, thereby limiting the firing of the bars.

* * * * *

UNITED STATES PATENT AND TRADEMARK OFFICE

CERTIFICATE OF CORRECTION

PATENT NO. : 5,392,931

DATED : February 28, 1995

INVENTOR(S) : Joseph Bielagus

It is certified that error appears in the above-indentified patent and that said Letters Patent is hereby corrected as shown below:

| | |
|---|---|
| Title page, item [75] Inventors: | "B. Bielagus, Tualatin" should be deleted. |
| Column 2, line 52: | "slob" should read --slots--. |
| Column 2, line 64: | "slob" should read --slots--. |
| Column 3, line 37: | "green" should read --screen--. |
| Column 4, line 49: | "cream" should read --create--. |
| Column 8, last line: 53 | "firing" should read --tilting--. |

Signed and Sealed this

Eleventh Day of July, 1995

*Attest:*

Bruce Lehman

BRUCE LEHMAN

*Attesting Officer*

*Commissioner of Patents and Trademarks*